US005566453A

United States Patent [19]

Lin

[11] Patent Number: 5,566,453

[45] Date of Patent: Oct. 22, 1996

[54] NIPPERS FOR GARDENING

[76] Inventor: Ching-Shui Lin, 58, Ma Yuan West St., Taichung, Taiwan

[21] Appl. No.: 529,955

[22] Filed: Sep. 18, 1995

[51] Int. Cl.[6] ..... B26B 17/02

[52] U.S. Cl. ..... 30/190; 30/134

[58] Field of Search ..... 30/134, 190, 251, 30/258

[56] References Cited

U.S. PATENT DOCUMENTS

| | | | |
|---|---|---|---|
| 3,520,058 | 7/1970 | Pfaffenbach | 30/134 |
| 3,530,576 | 9/1970 | Reichborn-Kjennerud | 30/134 |
| 5,159,757 | 11/1992 | Weid et al. | 30/251 |
| 5,170,559 | 12/1992 | Orthey et al. | 30/134 |
| 5,226,236 | 7/1993 | Harrington | 30/134 |

*Primary Examiner*—Douglas D. Watts

[57] ABSTRACT

A pair of shears comprises a driving blade, a follower blade and a pair of grips. The tang of the follower blade connects the front end of a grip. The rear end of the driving blade connects a link which connects the driving grip. The middle portion of the zigzag follower blade connects the driving blade. A curved fang is in the front portion of the follower blade. A clip seat is connected to the curved fang. Two rows of holding serrations are disposed on the surface of the clip side of the clip seat. The clip edge of the clip seat has an inner flange with two notches. An outer flange is disposed at the outer edge of the clip seat. The outer flange and the inner flange 341 define an upper recess on the upper surface of the clip seat. The upper recess receives the curved fang.

1 Claim, 4 Drawing Sheets

NIPPERS FOR GARDENING

BACKGROUND OF THE INVENTION

The invention relates to a pair of shears. More particularly, the invention relates to a pair of shears for gardening.

Referring to FIGS. 1 and 2, a pair of conventional shears has a driving blade 10, a follower blade 12 and a pair of grips 14. A packing clip 16 is pivotally disposed in front of the follower blade 12 to match the front portion of the driving blade 10. The driving edge 101 of the driving blade 10 matches the clip edge 161 of the packing clip 16. The driving edge 101 of the driving blade 10 will be blocked by the packing clip 16 while a branch A is cut. However, a thick branch cannot be cut with one clipping. The thick branch will slip out of the edges 101 and 161, so the conventional shears cannot position the thick branches very well.

SUMMARY OF THE INVENTION

An object of the invention is to provide a pair of shears which can position thick branches so that the branches will not slip out of the shears.

Accordingly, a pair of shears comprises a driving blade, a follower blade and a pair of grips. The tang of the follower blade connects the front end of a grip. The rear end of the driving blade connects a link which connects the driving grip. The middle portion of the zigzag follower blade connects the driving blade. A curved fang is in the front portion of the follower blade. A clip seat is connected to the curved fang. Two rows of holding serrations are disposed on the surface of the clip side of the clip seat. The clip edge of the clip seat has an inner flange with two notches. An outer flange is disposed at the outer edge of the clip seat. The outer flange and the inner flange 341 define an upper recess on the upper surface of the clip seat. The upper recess receives the curved fang.

DETAILED DESCRIPTION OF THE INVENTION

Figures 1, 2:
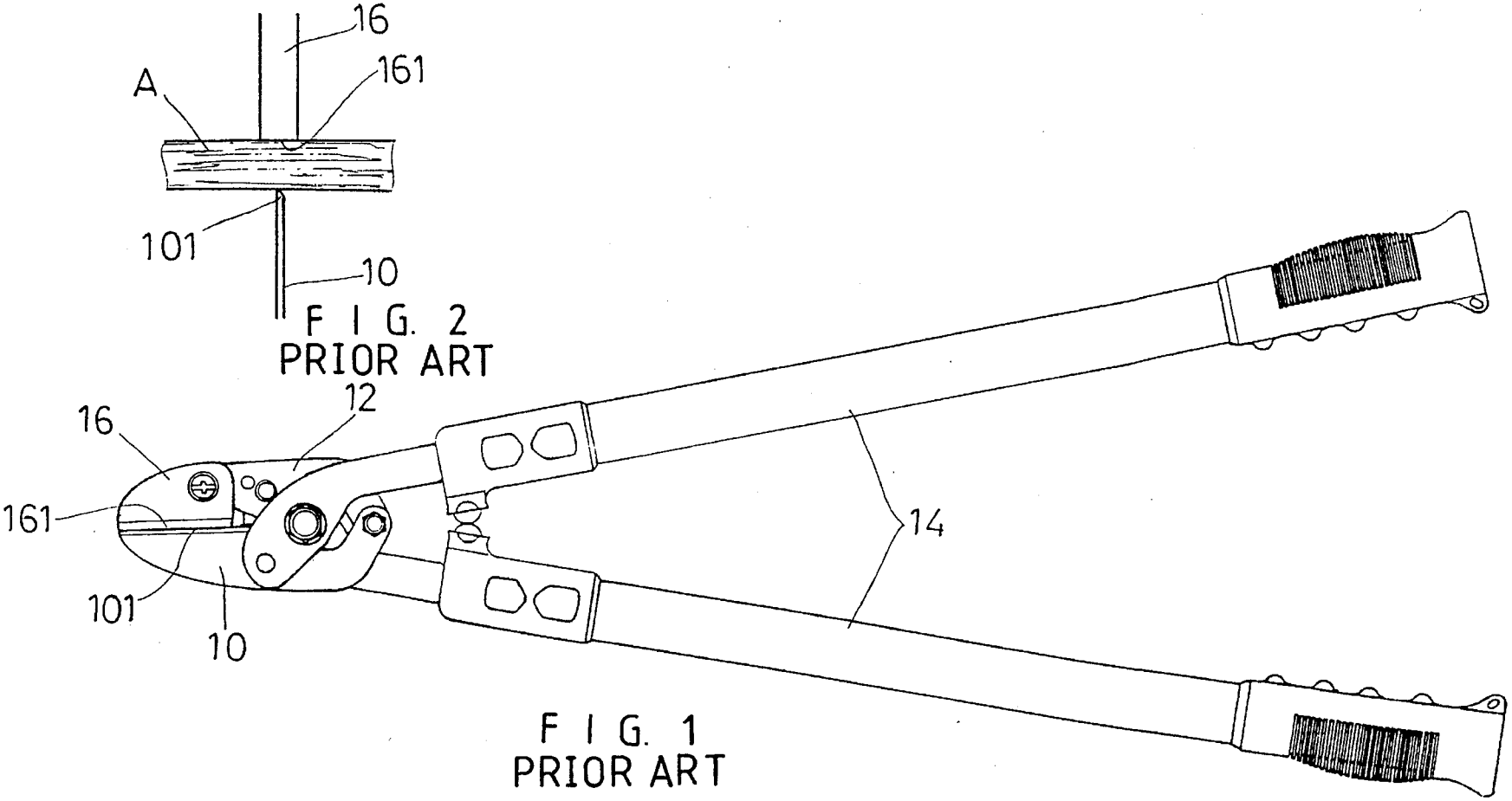
FIG. 1 PRIOR ART
FIG. 2 PRIOR ART
FIG. 1 is a perspective view of a pair of conventional shears of the prior art.
FIG. 2 is a schematic view illustrating the application of the cutting edges of the conventional shears.
Figure 3:
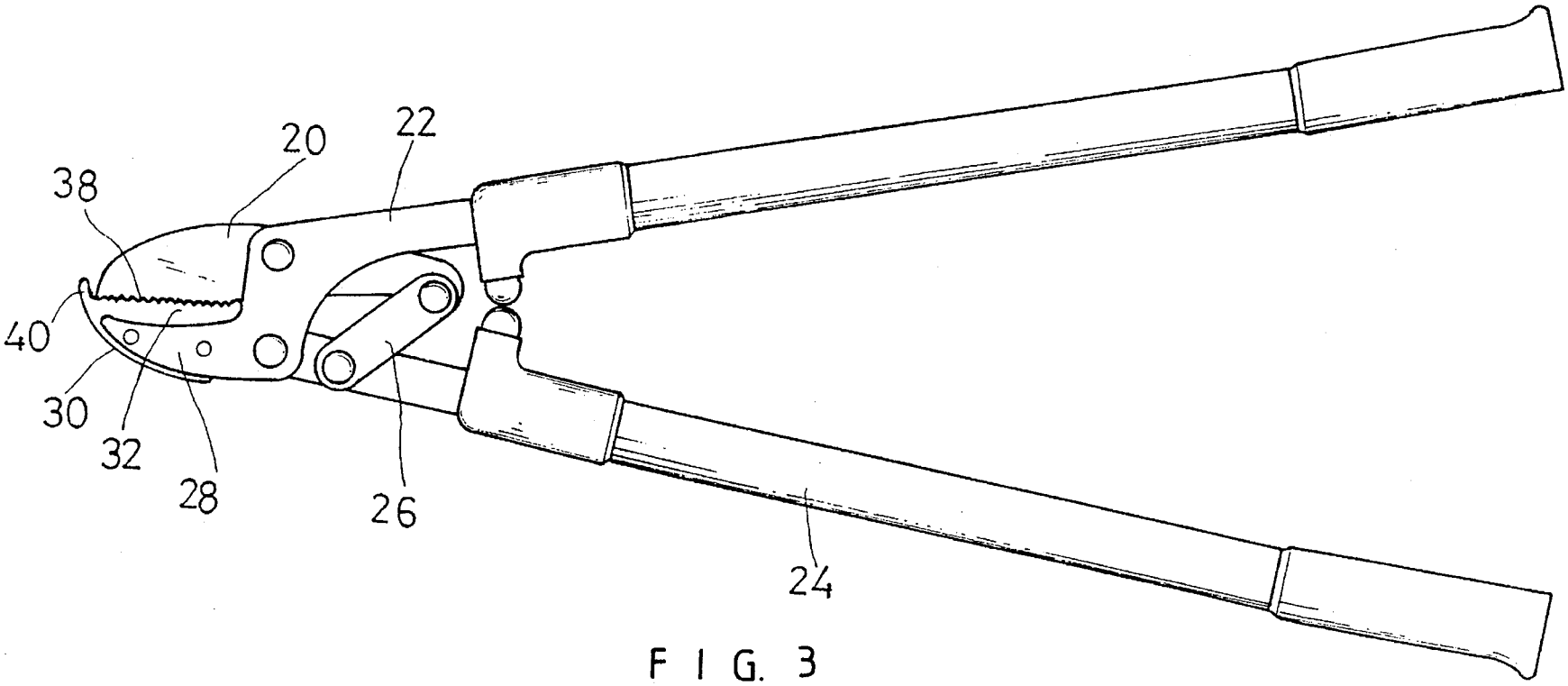
FIG. 3 is a perspective assembly view of a preferred embodiment in accordance with the invention.
Figure 4:
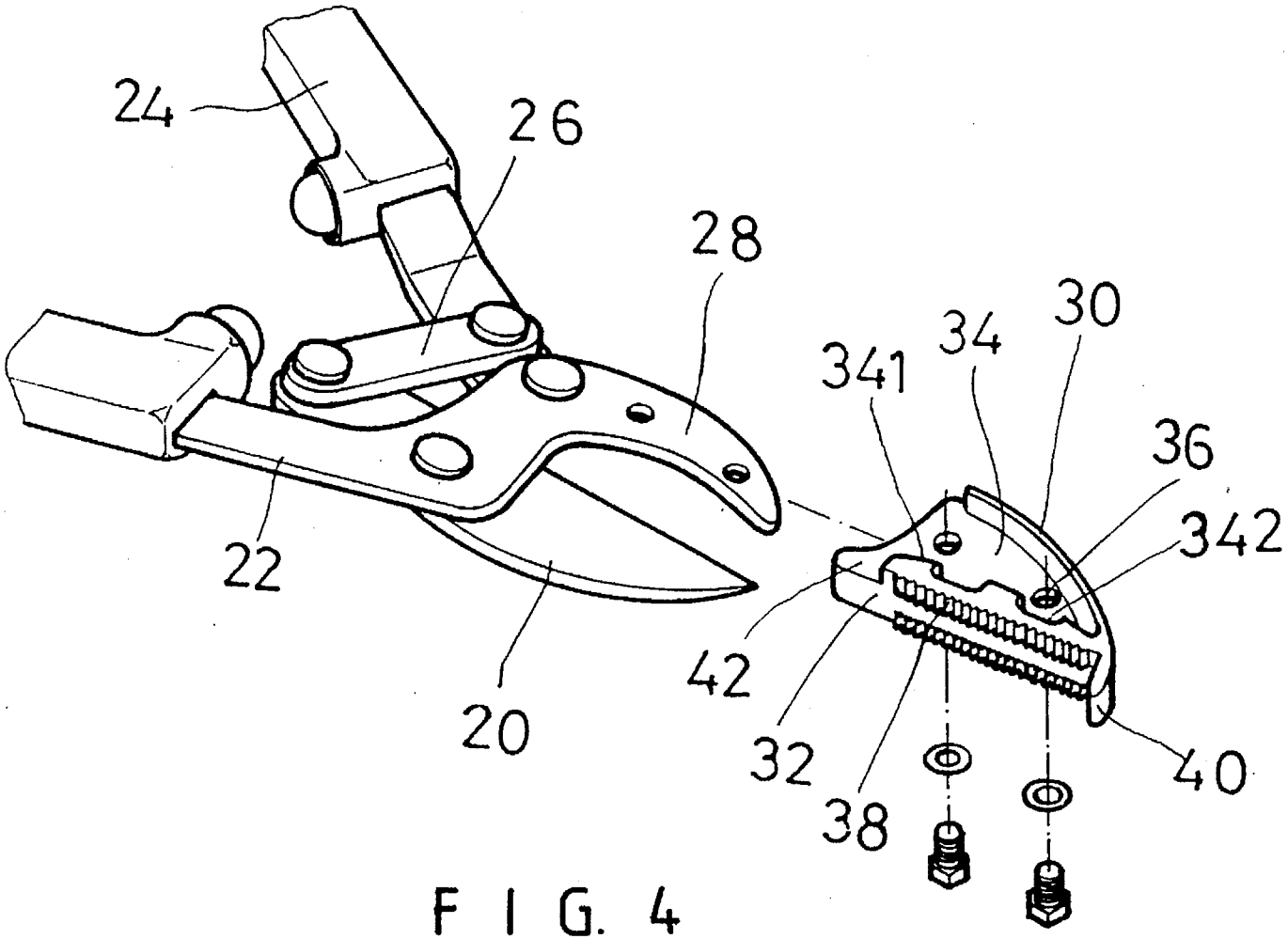
FIG. 4 is a partly perspective exploded view of FIG. 3.

FIG. 3 is a perspective assembly view of a pair of shears for gardening in accordance with the invention. FIG. 4 is a partly perspective exploded view illustrating the inventive features of the invention.

Referring to FIGS. 3 and 4, a pair of shears comprises a driving blade 20, a follower blade 22 and a pair of driving and follower grips 24. The tang of the follower blade 22 connects the front end of the follower grip 24. The rear end of the driving blade 20 connects a link 26 which connects the driving grip 24. The middle portion of the zigzag follower blade 22 connects the driving blade 20. A curved fang 28 is in the front portion of the follower blade 22. A clip seat 30 is connected to the curved fang 28. Two rows of holding serrations 38 are disposed on the surface of the clip side 32 of the clip seat 30. The clip edge 42 of the clip seat 30 has an inner flange 341 with two notches 342. An outer flange 40 is disposed at the outer edge of the clip seat 30. The outer flange 40 and the inner flange 341 define an upper recess 34 on the upper surface of the clip seat 30. Two through holes 36 are formed on the upper recess 34. The upper recess 34 receives the curved fang 28. The upper recess 34 and the curved fang 28 are fastened by screws.

Figure 5:
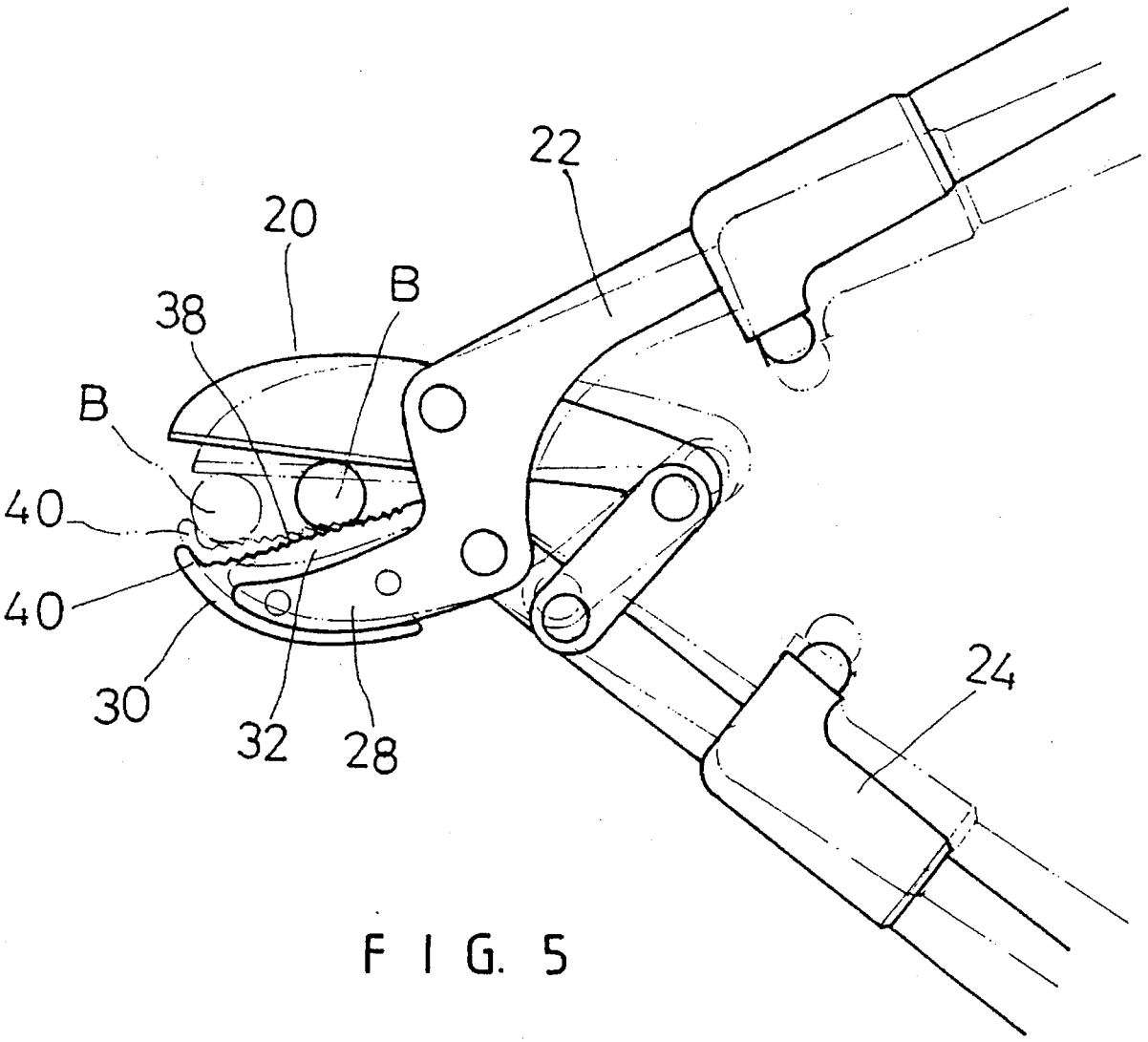
FIG. 5 is a schematic view illustrating the operation of FIG. 2.

Referring to FIG. 5, the holding serrations 38 of the clip edge 32 of the clip seat 30 engage with the driving blade 20 so that the branch B is clamped very well and the branch B will not slide out of the serrations 38. The space between two rows of the holding serrations 38 is used for protecting the driving blade 20 so that the driving blade 20 will not be damaged by avoiding the direct contact between the driving blade 20 and the holding serrations 38. The outer flange 40 of the clip seat 30 can prevent the branch B from sliding out of the driving blade 20.

The invention is not limited to the above embodiment but various modification may be made. It will be understood by those skilled in the art that various change in form and detail may be made without departing from the spirit and scope of the invention.

I claim:

1. A pair of shears comprises a driving blade, a follower blade and a pair of driving and follower grips, wherein the improvement is that:

a tang of said follower blade inserted in a front end of said follower grip;

a first end of a link connecting a rear end of said driving blade pivotally;

a second end of said link connecting a front portion of said driving grip pivotally;

a middle portion of said follower blade connecting said driving blade pivotally;

a curved fang disposed in a front portion of said follower blade;

a clip seat connected to said curved fang;

two rows of holding serrations disposed on a surface of a clip side of said clip seat;

a clip edge of said clip seat having an inner flange with two notches;

an outer flange disposed at an outer edge of said clip seat; an upper recess on an upper surface of said clip seat defined by said outer flange and said inner flange; and said upper recess receiving said curved fang.

* * * * *